US006662715B2

(12) United States Patent
Kanamaru et al.

(10) Patent No.: US 6,662,715 B2
(45) Date of Patent: Dec. 16, 2003

(54) SLIDER LINK PRESS

(75) Inventors: Hisanobu Kanamaru, Sagamihara (JP); Ito Takao, Sagamihara (JP); Hiromichi Fujimori, Hachioji (JP)

(73) Assignee: Aida Engineering Co., Ltd., Kanagawa (JP)

( * ) Notice: Subject to any disclaimer, the term of this patent is extended or adjusted under 35 U.S.C. 154(b) by 0 days.

(21) Appl. No.: 09/904,439

(22) Filed: Jul. 12, 2001

(65) Prior Publication Data

US 2002/0020308 A1 Feb. 21, 2002

(30) Foreign Application Priority Data

Jul. 21, 2000 (JP) ..... 2000-219980
Aug. 11, 2000 (JP) ..... 2000-243552

(51) Int. Cl.[7] ..... B30B 1/06

(52) U.S. Cl. ..... 100/282; 100/286; 100/283; 100/257

(58) Field of Search ..... 100/286, 285, 100/280, 281, 257, 282, 283, 293

(56) References Cited

FOREIGN PATENT DOCUMENTS

| | | |
|---|---|---|
| JP | 07 314191 | 12/1995 |
| JP | 11 226788 | 8/1999 |
| JP | 11 245096 | 9/1999 |

*Primary Examiner*—Allen Ostrager
*Assistant Examiner*—Shelley Self
(74) *Attorney, Agent, or Firm*—Darby & Darby

(57) ABSTRACT

A slider link press includes an oscillation link operating about a fulcrum shaft and an eccentric crank pin. A connecting link connects the oscillation link to a slide. The oscillating link and fulcrum shaft act to increase press torque, reduce downward press speed, and increases upward press speed thereby maintaining cycle time. The eccentric crank pin operates the oscillation link, aids in torque increase, and provides reciprocating movement to the slide. The slide includes pivotable slide gibs that engage reciprocal fixed gibs to maintain parallel surface contact and absorb and eliminate eccentric loads on the slide and the press. Stays and spacers align sides of the press and eliminate flexing under load while absorbing and distributing deformation pressure.

10 Claims, 17 Drawing Sheets

SLIDER LINK PRESS

BACKGROUND OF THE INVENTION

1. Field of the Invention

The present invention relates to a slider link press. More precisely, the present invention relates to a slider link press having high operational precision and increased pressing force.

2. Description of the Related Art

Japanese Laid-Open Patent Publication No. 11-226788, presently owned by Applicant, is an example of a slider link press. The slider link press includes a crank shaft that rotates in a horizontal direction on a frame above a slide. An oscillating link is perpendicular to the crank shaft and faces a roughly horizontal direction. The oscillating link pivots in a reciprocating manner around an oscillation fulcrum shaft as a center. The oscillation fulcrum shaft is parallel to and at a separate position from a crank shaft. A slider joins rotatably with a crank pin on the crank shaft and is slidable in a linear groove provided in the longitudinal direction of the oscillating link.

A vertical connecting link, has two ends connected in a freely oscillating manner between a lower surface of the oscillating link and the upper surface of the slide. The rotation output of the crank shaft is converted to a reciprocating motion by the oscillating link and the slide operates.

In this related art, the crank shaft is aligned through the front of the slide press, and the oscillating link is perpendicular with this crank shaft. A hole for a crank shaft is perforated on a left-side plate and a right-side plate in the crown. This requirement greatly weakens the frame body and reduces rigidity during operation. This requirement further forces drive mechanisms (motor and fly wheel) to one side of the slide link press, resulting in instability and loss of balance. Compensation for these drawbacks requires a large and expensive frame to minimize vibration and maintain alignment. This cure fails to increase productivity.

Japanese Laid Open Utility Model Publication No. 63-56996, is an example of a rigid press machine requiring a tubular spacer inserted between each column in a front-back and left-right direction. A supporting tie rod passes through the spacer and the columns on either side and binds them together. As a result, the deformation in the columns under load is reduced, and working precision is improved.

However, while the interval between the columns can be maintained, the cross-sectional area of the spacer is small, and the deformation stress of the columns cannot be absorbed. Thus, when an eccentric load is applied on the slide, an edge of the slide contacts the slide guide in a linear manner and 'slide galling' frequently results and permanently damages the slide guide. When this type of linear contact 'slide galling' occurs, the slide does not operate smoothly and work precision and productivity greatly suffer.

OBJECTS AND SUMMARY OF THE INVENTION

It is an object of the present invention is to provide a rigid slider link press.

It is another object of the present invention to provide a press with a slide link where the slide decent time is slowed and the ascent time is speeded up.

It is another object of the present invention to provide a press where press torque is increased at bottom dead center.

It is another object of the present invention to provide a press where a center of gravity of a fly wheel is lowered and vibration is reduced.

It is another object of the present invention to provide a press that withstands and absorbs eccentric loads placed on a slide and operates smoothly without undue wear.

It is another object of the present invention to provide a press where a stay and spacer absorb and distribute deformation pressure and prevent frame damage.

It is another object of the present invention to provide a press with horizontal rigidity during press operations.

Briefly stated, the present invention relates to a slider link press which includes an oscillation link operating about a fulcrum shaft and an eccentric crank pin. A connecting link connects the oscillation link to a slide. The oscillating link and fulcrum shaft act to increase press torque and reduce downward press speed while increasing upward press speed. The eccentric crank pin operates the oscillation link, aids in torque increase, and provides reciprocating movement to the slide. A slide includes pivotable slide gibs that engage reciprocal fixed gibs to maintain parallel surface contact and absorb and eliminate eccentric loads on the slide and press. Stays and spacers align sides of the press and eliminates flexing under load while absorbing and distributing eccentric deformation pressure.

According to an embodiment of the present invention, there is provided a slider link press device, comprising: a crank shaft and a fulcrum shaft, first means for linking the crank shaft to the fulcrum shaft, the first means being operable in a first arc about the fulcrum shaft, a crank pin on the crank shaft, the crank pin providing an eccentric displacement to the first means, a slide having a top and a bottom dead center position, second means for linking of the first means to the slide, the first means being effective to receive the eccentric displacement and to operate in the first arc to drive the slide in a cycle, the first means perpendicular to the crank shaft and the fulcrum shaft, the first means permitting an increase in a force applied to the slide at the bottom dead center position and permitting an increase in a slide descent time whereby a precision increases and a slide assent time decreases, guiding means for guiding the slide in a cycle, and the guiding means permitting elimination of eccentric loads upon the slide while the slide operates in the cycle whereby the precision increases.

According to another embodiment of the present invention there is a slider link press device, wherein: the fulcrum shaft includes a fulcrum shaft center, the first link means is horizontal to the fulcrum shaft center at the bottom dead center position, the eccentric displacement is a trajectory circle, an angular velocity of the crank shaft is constant, a first position (O) is a rotation center of the crank shaft, a first tangent point (PT) is defined on the trajectory circle at the top dead center position respective to the fulcrum shaft center, a second tangent point (PR) is defined on the trajectory circle at the bottom dead center position horizontal to the fulcrum shaft center, a first angle (θ1) is a first link means oscillation angle between the first tangent point (PT), the fulcrum shaft center, and the second tangent point (PR), a second angle (θ2) is defined between the first tangent point (PT), the first position (O), and the second tangent point (PR), the first angle (θ1) and the second angle (θ2) have the following relationship, and $$(\theta 2)\text{minimum}=180\text{ degrees}-(\theta 1) \quad \text{(I)}$$

$$(\theta 2)\text{maximum}=180\text{ degrees}+(\theta 1) \quad \text{(II)}$$

the second link means descends under formula (II) whereby the a torque at the bottom dead center is increased and decent time is increased.

According to another embodiment of the present invention there is provided a slider link press device, wherein: a distance L1 is defined between a maximum eccentricity of said crank pin 11 and said fulcrum shaft center, a distance L2 is defined between the center of said first link means and said fulcrum shaft center, a center of said first link means is a center axis of said slide, a first torque applied to said crank pin is F1, a second torque applied to said slide is F2, said first torque is at a minimum where F1=F2 and said slide is at said top and bottom dead center positions, said slider link press effective to increase during an operating cycle of said slide as said crank pin travels from the top dead center to the bottom dead center, and said second torque is at a maximum at a maximum eccentricity of said crank pin and where $F2=F1\times L1/L2$ and said first means is effective to increase said second torque.

According to another embodiment of the present invention there is a slider link press device, further comprising: a drive assembly, the drive assembly effective to drive the crank shaft, a speed reducing module and a fly wheel in the drive assembly, a frame assembly supporting the drive assembly and the slide, and the crank shaft above the slide.

According to another embodiment of the present invention there is a slider link press device, wherein: the frame assembly includes a crown assembly, the crown assembly above the slide, the first link means, the crank shaft, and the fulcrum shaft in the crown assembly, and the fly wheel having a center of gravity below the crown, whereby stability is increased and operating vibration is reduced.

According to another embodiment of the present invention there is a slider link press device, wherein: the slide includes a vertical slide center, the slide center being a press center, and the rotation center vertically aligned with the press center.

According to another embodiment of the present invention there is a slider link press device, further comprising: at least first and second columns in the frame, the first and second columns below the crown, at least first and second stays, the first and second stays between the first and second columns at the bottom dead center position, and the first and second stays operably joining the first and second columns whereby the columns are maintained parallel and the frame is rigid and resists high operating pressure and eccentric slide pressure.

According to another embodiment of the present invention there is a slider link press device, further comprising: a plurality of vertical corner surfaces on the slide, a plurality of fixed gibs on the guiding means, the fixed gibs along inner surfaces of the first and second columns, the fixed gibs opposite the slide, the fixed gibs aligned adjacent to the corner surfaces, the corner surfaces being slidably aligned with the fixed gibs, a plurality of slide gibs on the guiding means, the plurality of slide gibs on the corner surfaces, the slide gibs having an engagement surface parallel to the fixed gibs, and means for pivoting the slide gibs relative to the fixed gibs, and the pivoting means effective to maintain the engagement surfaces parallel to the fixed gibs whereby the fixed gibs slidably guide the slide and eliminate eccentric forces on the slide.

According to another embodiment of the present invention there is a slider link press device, further comprising: a plurality of holes in the pivot means, the slide gibs in each the hole, the slide gibs pivotable in each the hole, the holes at a top and bottom side of each the corner surface, the first and second stays are equidistant the slide gibs when the slide is at the bottom dead center position, and the stays, the slide gibs, and the pivot means absorb eccentric forces whereby the first and second columns are maintained in parallel and the slide operates parallel to the fixed gibs.

According to another embodiment of the present invention there is a slider link press device, further comprising: at least one spacer, the spacer between each the stay and each respective the first and second column, the spacer selectable to maintain the first and second columns in parallel, and the spacer being effective as a slip plane whereby the spacer minimizes damage to the first and second columns during tightening the stays.

According to another embodiment of the present invention there is provided a slider link press, having a slide operated by converting a rotational crank shaft output converted to a reciprocating motion by an oscillating link, comprising: an oscillation fulcrum shaft, the oscillation fulcrum shaft parallel to the crank shaft, the oscillating link effective to operably join the oscillation fulcrum shaft and the crank shaft, the oscillating link receiving the output as an eccentric displacement, the oscillating link operation in an arc about the oscillation fulcrum shaft, crank pin on the crank shaft, the crank pin effective to transfer the eccentric displacement to the oscillating link, and the oscillating link effective to transfer the reciprocating motion to the slide and act as a force multiplier whereby the slide operates with increased pressing force, has a lower descent time and a faster ascent time.

According to another embodiment of the present invention there is provided a slider link press, further comprising: a speed reduction module, a fly wheel, the speed reduction module and the fly wheel effective as drive modules for the crank shaft, a frame, the frame including the drive modules and the slide, the fly wheel and the speed reduction modules effective to provide the eccentric displacement to the crank pin whereby the slide operates in a cycle.

According to an embodiment of the present invention there is provided a slider link press device in which a frame includes first and second columns, and a slide operates between the columns, comprising: first and second stays, the first and second stays between the first and second columns, the first and second stays effective to rigidly join the first and second columns, and the first and second stays effect to resist an eccentric force of the crank shaft whereby the first and second columns are maintained in parallel.

According to another embodiment of the present invention there is provided a slider link press device, further comprising: at least one spacer, the spacer between each the first and second column and each respective the first and second stay, and the spacer having a thickness effective to maintain the first and second columns in parallel.

The above, and other objects, features, and advantages of the present invention will become apparent from the following description read in conjunction with the accompanying drawings, in which like reference numerals designate the same elements.

DESCRIPTION OF THE PREFERRED EMBODIMENTS

Figure 1:
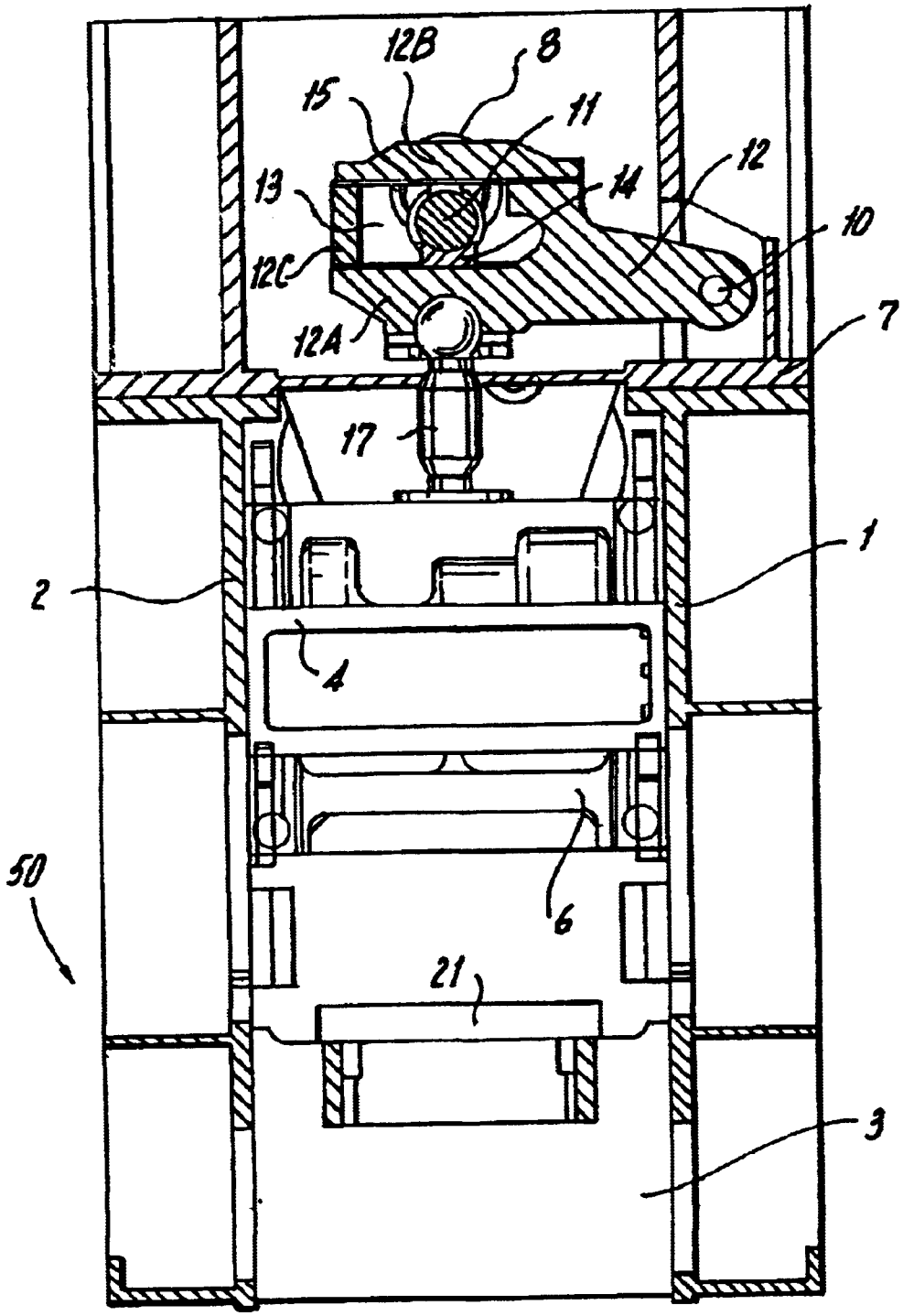
FIG. 1 is a front view of the principal parts of a slide press.
Figure 2:
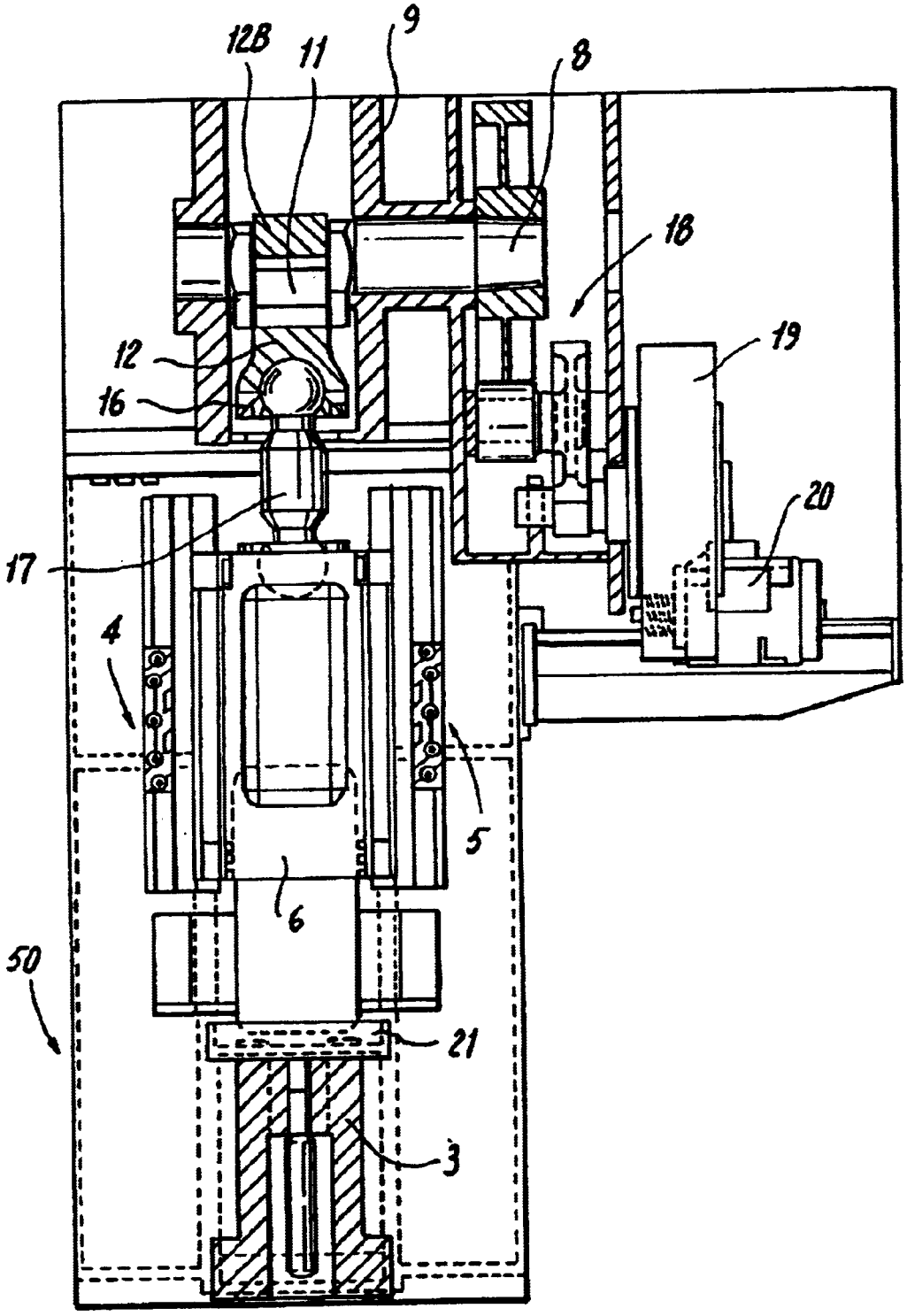
FIG. 2 is a longitudinal side view of FIG. 1.

Referring to FIGS. 1 and 2, an embodiment of a slider link press 50 includes a first column 1 and a second column 2. Columns 1, 2 form a left and right side wall of slider link press 50. A rib 3 joins a bottom portion of columns 1, 2. A pair of stays 4, 5 join an upper portion of columns 1, 2. Rib 3 and stays 4, 5 act to maintain equal spacing between columns 1, 2, as will be explained.

A slide 6 operates between stays 4, 5 above rib 3. A bolster 21 is on rib 3 opposite slide 6. A crown 7 fixes and joins upper parts of columns 1, 2. A front and back rib 9 are included in crown 7. A crank shaft 8 extends horizontally to crown 7. Crank shaft 8 is rotatably supported as it passes through the walls of front and back rib 9.

An oscillation fulcrum shaft 10 is on a right side of crown 7. Oscillation fulcrum shaft 10 is generally parallel with crank shaft 8, as will be explained.

An oscillating link 12 is pivotably retained on one side by oscillation fulcrum shaft 10. A crank pin 11 slidably joins oscillating link 12 to crank shaft 8, as will be explained. Oscillating link 12 operates in a reciprocating arc-type motion about oscillation fulcrum shaft 10, as will be explained.

A crank pin insertion window 13 extends in a longitudinal direction in oscillating link 12. Crank pin 11 is operably retained in insertion window 13 by a pair of sliders 14, 15. Crank pin 11 therefore slides forward and backward during operation relative to oscillating link 12. Crank pin 11 is eccentric to crank shaft 8.

Insertion window 13 of oscillating link 12 includes a base module 12A and an opposing lid module 12B. During assembly, crank pin 11 is retained in oscillating link 12 and insertion window 13 by a lid body 12C. Lid body 12C is attached to respective base module 12A and lid module 12B by bolts or screws. It is to be understood, that lid body 12C may be affixed to oscillating link 12 by any manner effective to operably retain crank pin 11.

Spherical bearings 16 are on both an upper surface of slide 6 and an opposing lower surface of oscillating link 12. Spherical bearings 16 are generally vertically opposite each other. A connecting link 17 is retained between spherical bearings 16. Connecting link 17 has spherical ends that rotatably mate with respective spherical bearings 16. Connecting link 17 and spherical bearings 16 mechanically and operably link slide 6 to oscillating link 12.

A multistage speed reduction gear assembly 18 connects to a back end of crank shaft 8. A motor 20 and a fly wheel 19 provide multistage speed reduction gear assembly 18 with drive force. The drive force from multistage speed reduction gear assembly 18 drives a back end of crank shaft 8.

It should be understood that an upper and lower die (both not shown) are affixed respectively to a lower surface of slide 6 and to an upper surface of bolster 21. The dies are used in the pressing of a product.

Figure 3:
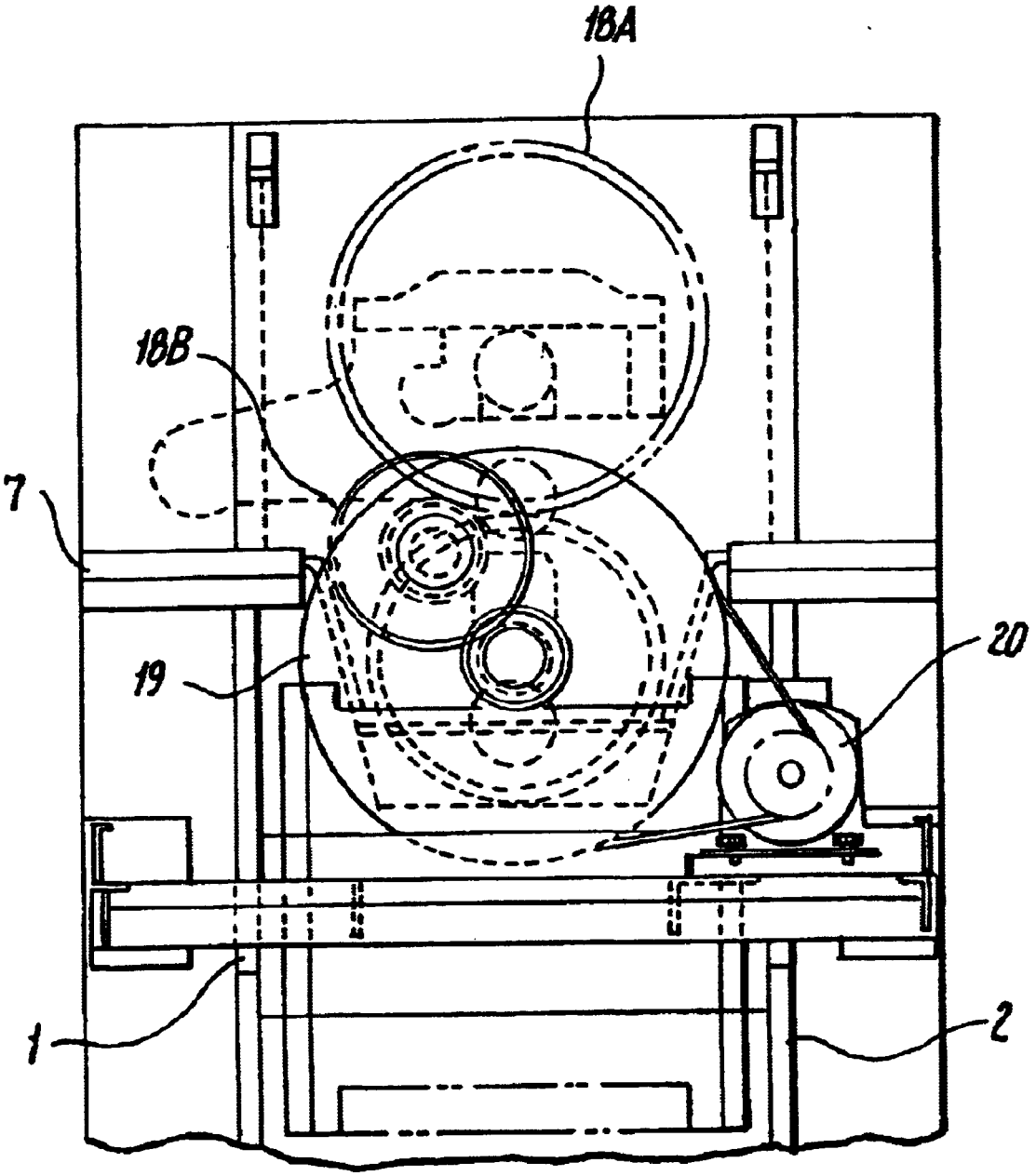
FIG. 3 is a partial rear view of FIG. 1.

Additionally referring now to FIG. 3, a main gear 18A, of multistage speed reduction gear assembly 18 is in a middle section between a left and a right side column portions 1A, 2A. A middle gear 18B and a fly wheel 19 are also positioned in the middle section and provide drive force to multistage speed reduction gear assembly 18.

It should be noted that the center shaft of fly wheel 19 is positioned below crown 7. The center of gravity of fly wheel 19 is therefore below crown 7 and provides an important stability to slider link press 50, reduces vibration, and improves safety.

It should be additionally noted that main gear 18A, middle gear 18B, and fly wheel 19 are generally positioned along a vertical centerline between columns 1, 2 thereby further centering the center of gravity of speed reduction gear assembly 18. This positioning further reduces operational vibration.

Figure 4:
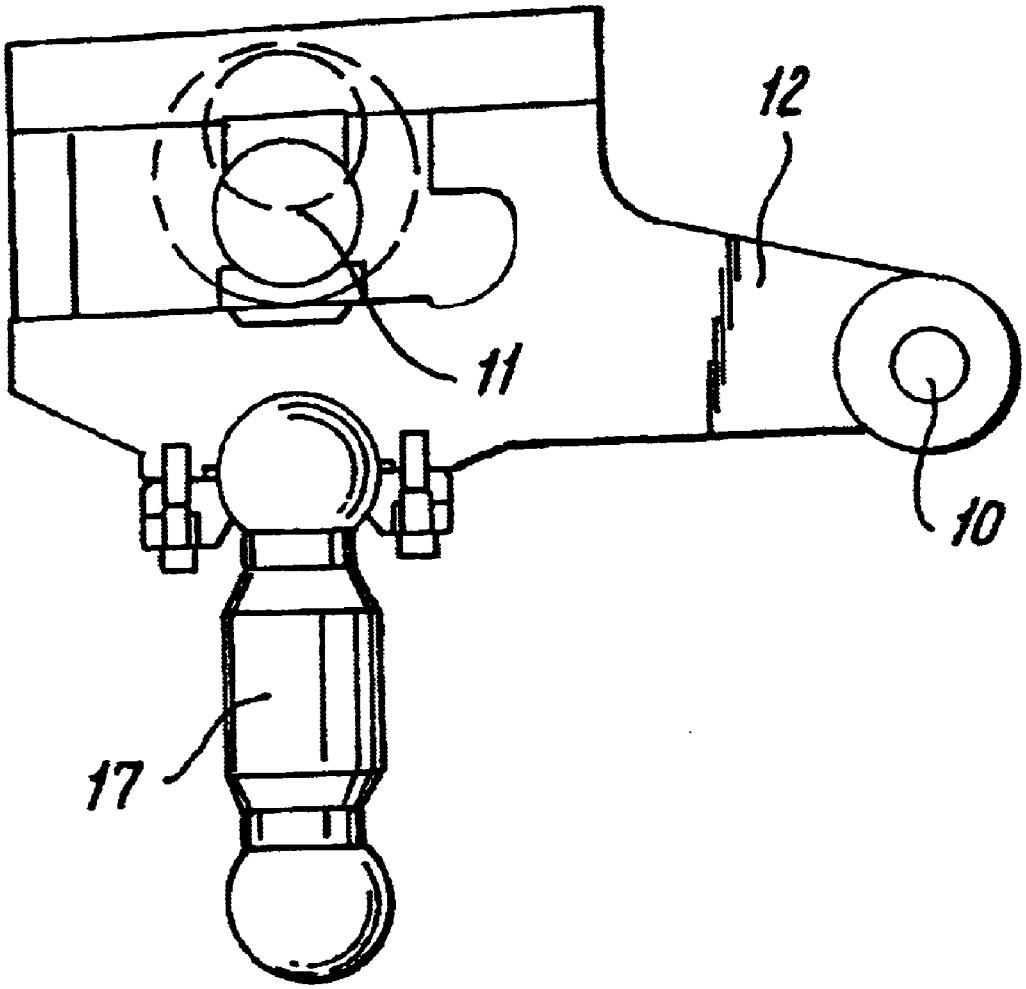
FIG. 4 is a view of an oscillating link with a slide at a bottom dead center position.

Additionally referring now to FIG. 4 where oscillating link 12 and slide 6 are at a bottom dead center position. In the bottom dead center position, the position of crank pin 11 is aligned with a horizontally extended center line (PR) (not shown) from fulcrum shaft 10.

Figure 5:
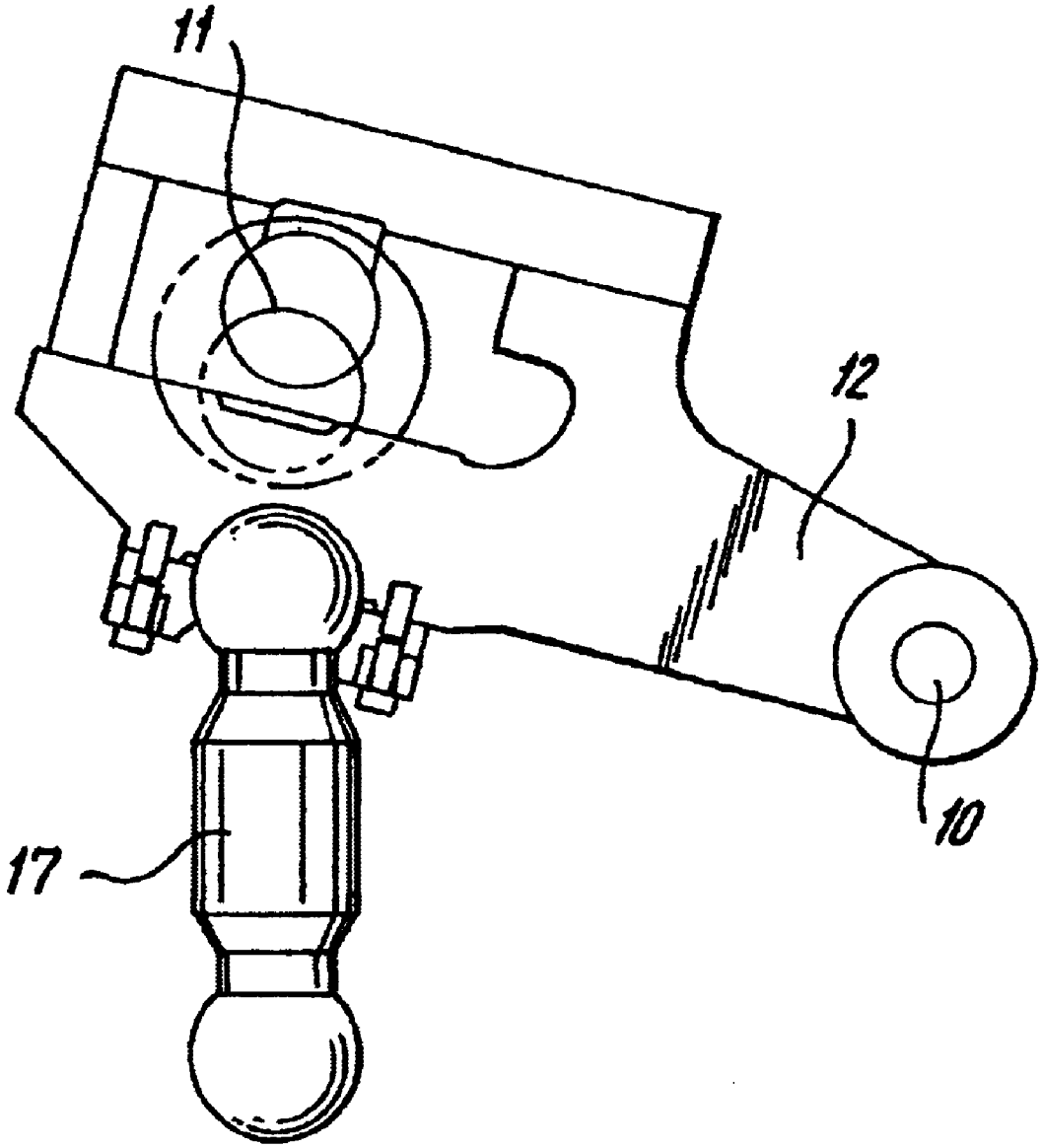
FIG. 5 is a view of an oscillating link with a slide at a top dead center position.

Additionally referring now to FIG. 5, where oscillating link 12 and slide 6 are at a top dead center position. In the top dead center position oscillating link 12 and slide 6 are at a maximum distance in an operational cycle.

Figure 6:
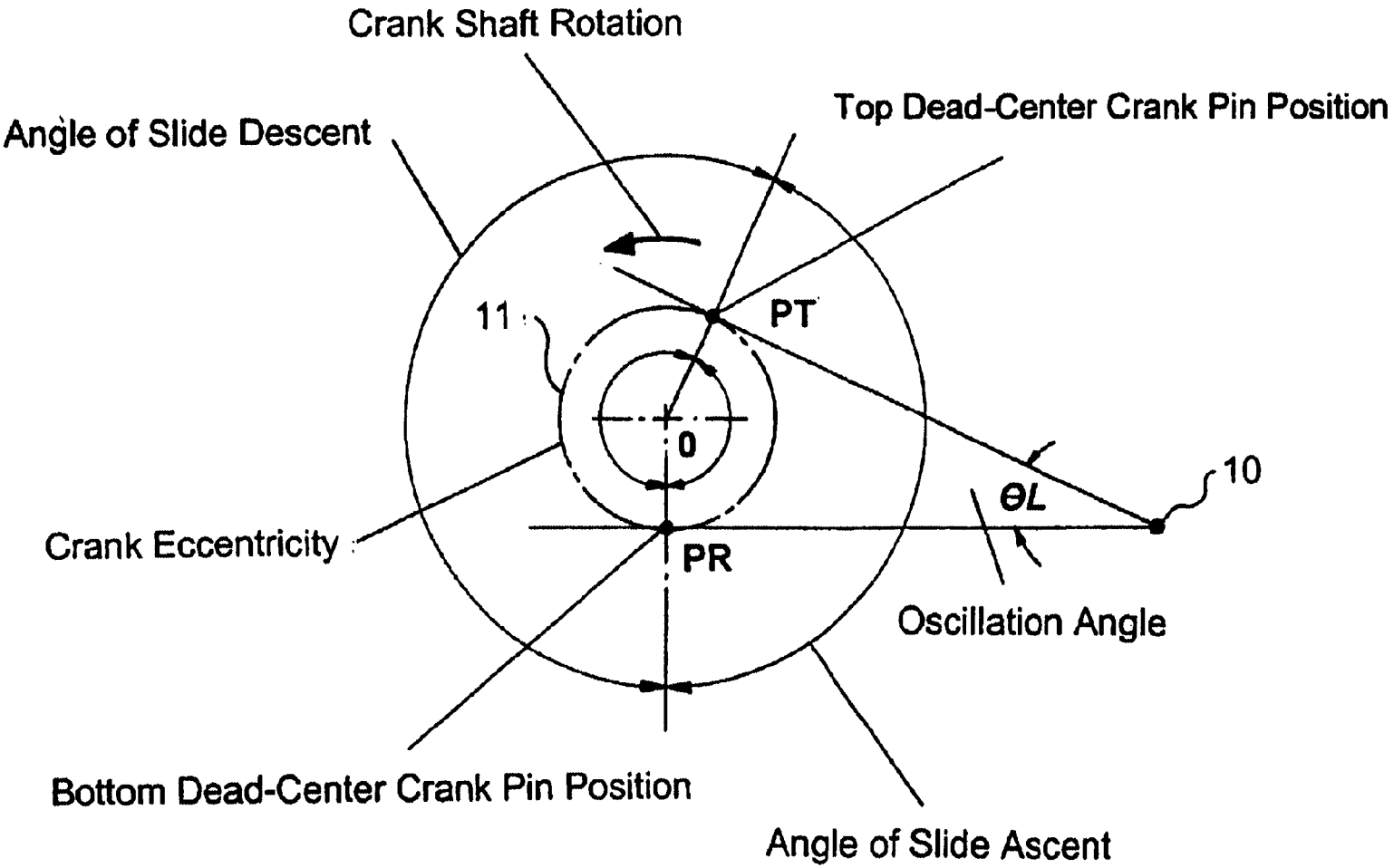
FIG. 6 is a motion model diagram of the oscillating link.

Additionally referring now to FIG. 6, where the operational position of crank pin 11 is shown as tangent points on a trajectory circle of crank pin 11. The trajectory circle is determined by the eccentric amount of crank 8 and fulcrum shaft 10.

At top dead center, the position of crank pin 11 is at a tangent point (PT) on a line that joins the trajectory circle of crank pin 11 with fulcrum shaft 10.

At bottom dead center, a position (PR) of crank pin 11 is on a horizontally extending center line of fulcrum shaft 10 of oscillation link 12 and is at a tangent point to the trajectory circle of crank pin 11.

An angle theta L (θL) is a link oscillation angle is defined between tangent point (PT), the center of oscillation fulcrum shaft 10, and horizontal extending center line (PR).

A position (O) is a rotation center of crank shaft 8.

An angle PR-O-PT, connecting tangent points PT and PR is:

$$\text{At a minimum at, angle } PR\text{-}O\text{-}PT = 180 \text{ degrees} - \text{theta } L(\theta L) \quad \text{(III)}$$

$$\text{At a maximum at, angle } PR\text{-}O\text{-}PT = 180 \text{ degrees} + \text{theta } L(\theta L) \quad \text{(VI)}$$

During operation, the angular velocity of crank shaft 8 is constant. By setting the rotation direction of crank shaft 8 so that connecting link 17 is descending when in the above situation (VI), slide 6 of slider link press 50 has a longer descent time and a shorter ascent time and torque is increased.

During operation, the rotation of crank shaft 8 drives crank pin 11, and oscillating link 12 oscillates in an up-and-down arc motion. Oscillating link 12 is connected with oscillation fulcrum shaft 10 as a rotation center. Connecting link 17, operably joined to oscillating link 12 has a corresponding general up-and-down motion.

Figure 7:
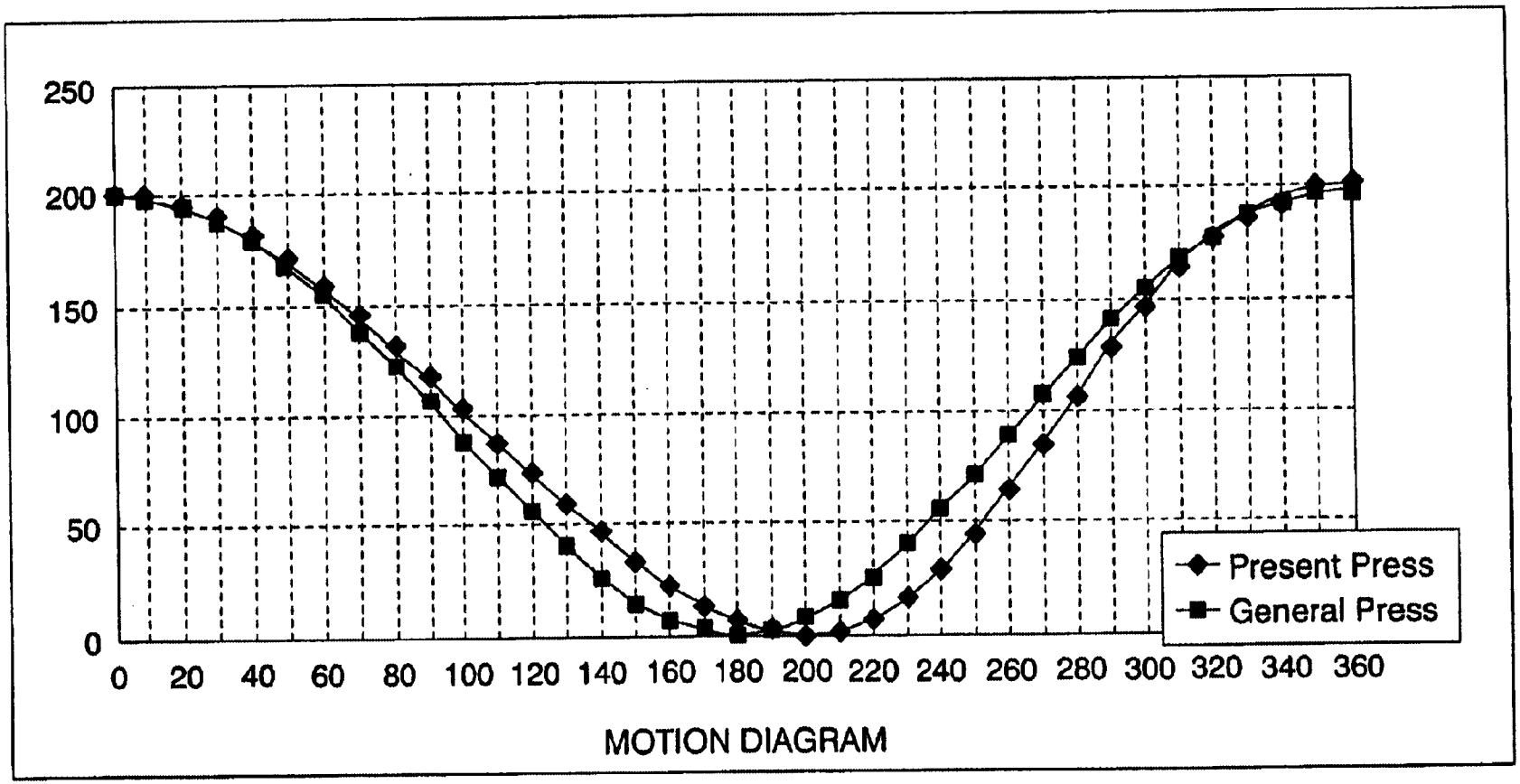
FIG. 7 is a comparative diagram of motion waveforms for the press.

Referring additionally now to FIG. 7, a motion comparison is made between a general crank press (solid line with box) and the present embodiment slider link press 50 (solid line with diamond).

The present embodiment of slider link press 50 is shown through one operation cycle as having a longer and slower descending stroke and a shorter and quicker ascending stroke. It is to be understood, that such modification of the stroke time is beneficial to accuracy and precision. As shown, the general crank press has a low point at 180 degrees of rotation and the present embodiment has a low point beyond 180 degrees. The degree of difference is the time difference. It is to be understood that the total slide 6 cycle time remains the same and that the rate of travel of slide 6 changes during the cycle.

It should be additionally understood that the horizontal center of crank shaft 8 and a vertical press center (not shown) of slide 6 are aligned on the same vertical axis, further beneficially influencing the cycle time, stroke length, and press torque.

Figure 8:
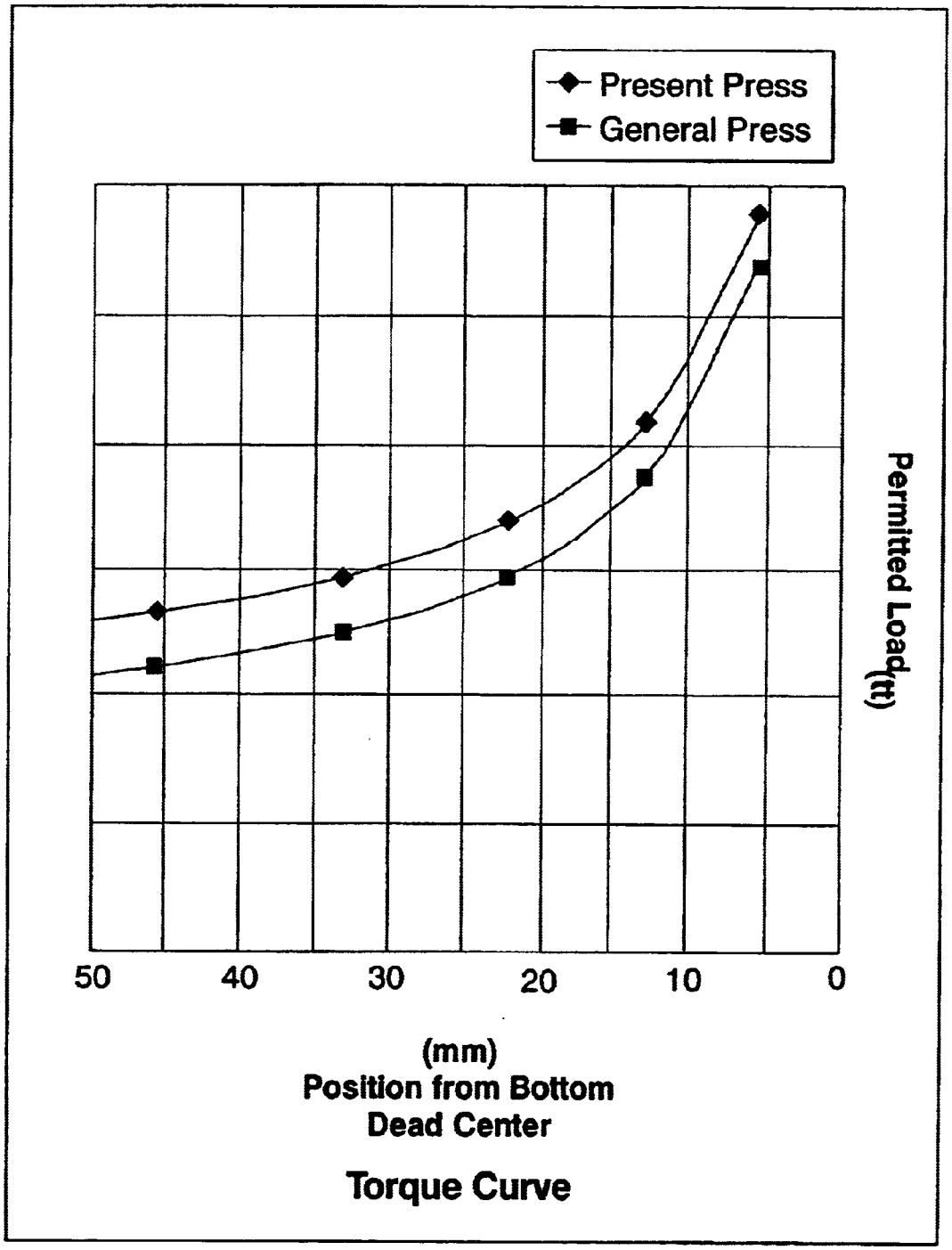
FIG. 8 is a comparative diagram of motion waveforms of torque curves for the press.

Additionally referring now to FIG. 8, a torque comparison indicates that the allowable load in the present embodiment is greater than that of a general crank press. This additional load is excellent for precision cold forging and is an important, but not only, result of the present invention.

It is to be understood, that positioning the elements of the present construction improves both balance and rigidity, reduces the size of slider link press 50, and improves operational efficiency. Specifically, connecting link 17 is directly above slide 6 and perpendicular to crank shaft 8 while oscillation fulcrum shaft 10 is parallel to crank shaft 8, thereby increasing left-right symmetry in the device and reducing overall size.

It is to be further understood, that by positioning the components as listed above and shown in the drawings, frame holes are minimized in slider link press 50 and rigidity and compactness are again improved and vibration restricted.

It is to be further understood that since speed reduction gear assembly 18 and fly wheel 19, are positioned between ribs 9 in the back part of crown 7, the size of slider link press 50 is reduced, balance is improved, vibration reduces, and a higher productivity results.

It should be further understood, that positioning the center of gravity of fly wheel 19 below the position of crown 7, vibration is further reduced and stability increased.

Figure 9:
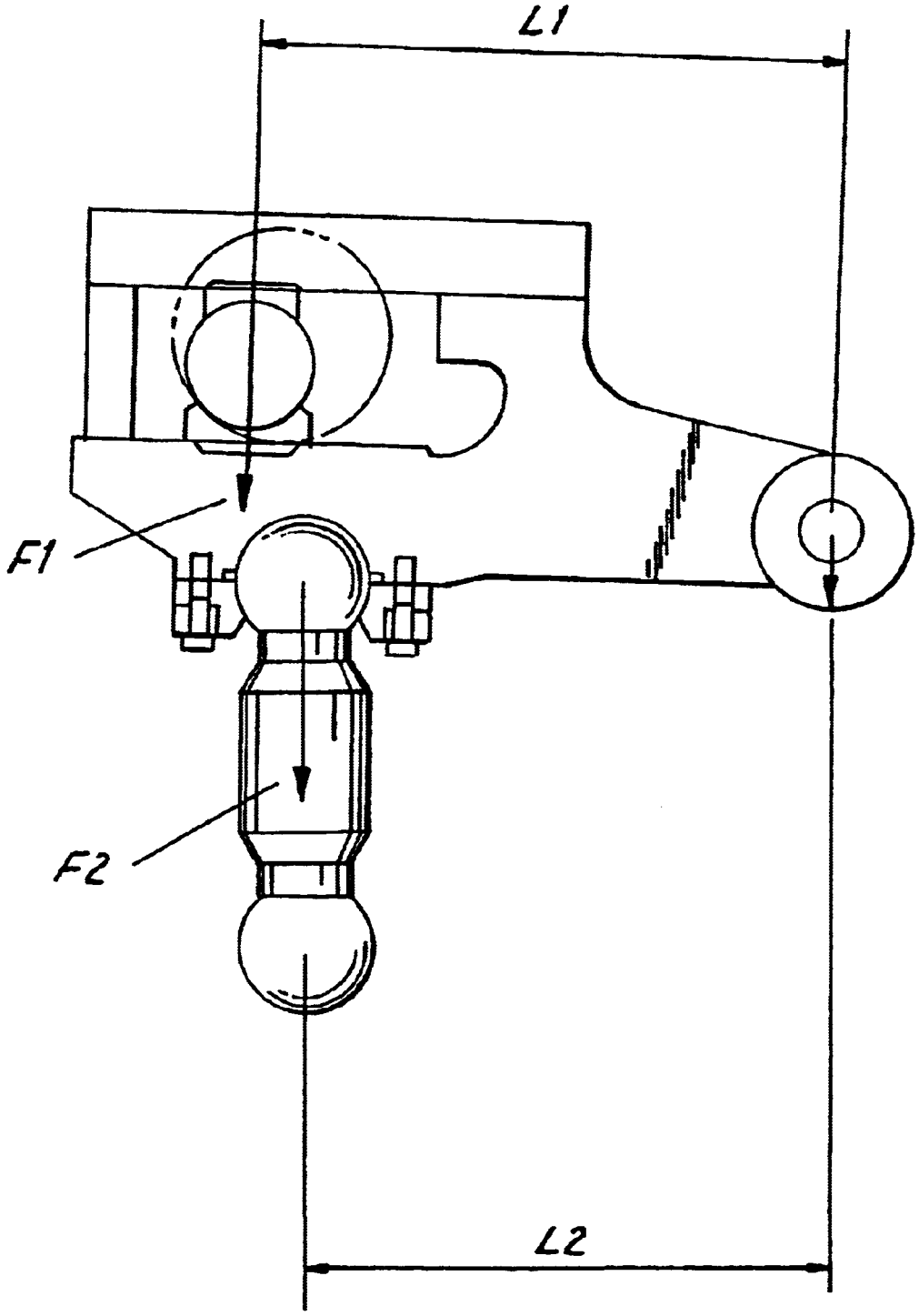
FIG. 9 is a working torque distribution diagram for the press.

Referring additionally now to FIG. 9, where the center axis of press 50 (slide 6) and crank shaft 8 are aligned to the same vertical axis. As described above, the center of crank shaft 8 is defined as O (previously shown). A distance L1 is defined between a maximum eccentricity of crank pin 11 and a center of oscillation fulcrum shaft 10. A distance L2 is defined between the center axis of connecting link 17, and the center of oscillation fulcrum shaft 10.

The center of connecting link 17 is to be understood as the center axis of slide 6.

The pressure (torque) applied to crank pin 11 is defined as F1. The pressure applied to slide 6 is defined as F2. It is to be understood, that the pressure applied on crank pin 11 is at a minimum value where F1=F2 at slide 6 top dead center and bottom dead center positions.

It is to be further understood, that the pressure (torque) increases during an operating cycle of slider link press 50, as crank pin 11 travels from the top dead center to the bottom dead center. The combined pressure (torque) at the maximum eccentricity of crank pin 11, is defined by the formula $F2=F1\times L1/L2$.

It should be understood, that oscillation link 12 operates as a lever and boots pressure (torque) and power with respect to operating slide crank press 50. Where L1, maximum eccentricity, increases, pressure (torque) also increases.

Figure 10:
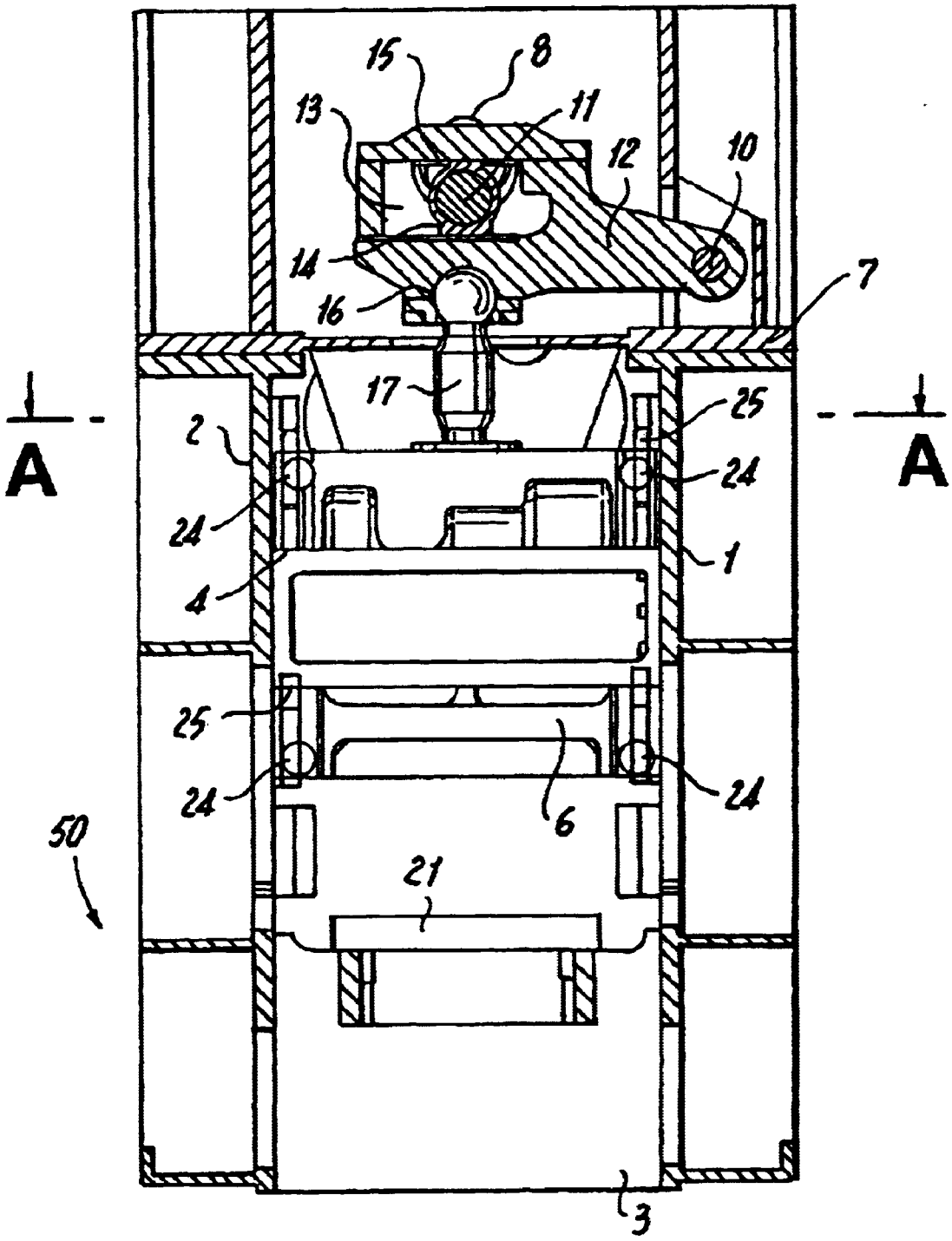
FIG. 10 is a front view of an embodiment of the press.
Figure 11:
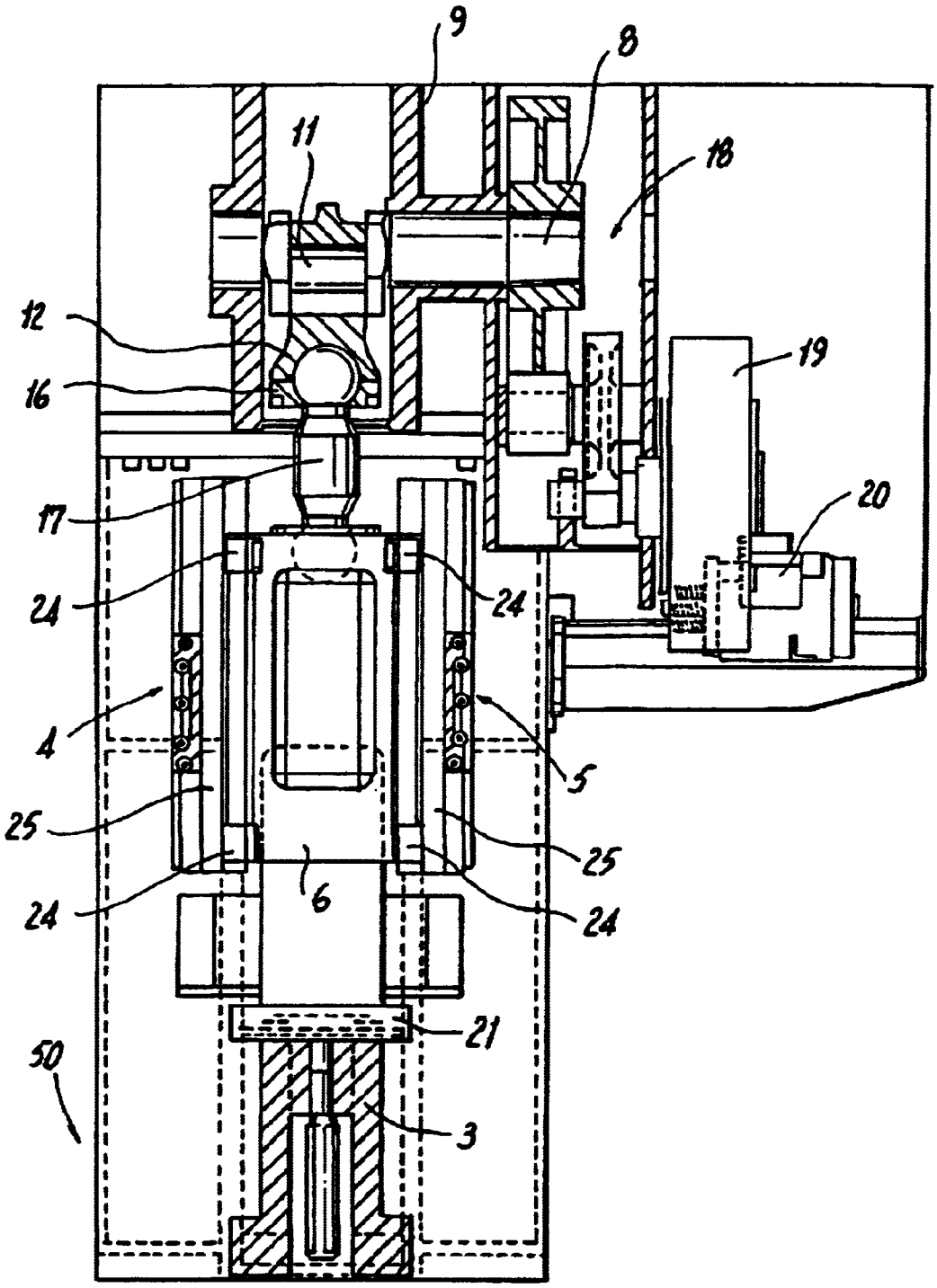
FIG. 11 is a longitudinal side view of FIG. 10.

Additionally referring now to FIGS. 10 and 11, bolster 21 is below slide 6. Two sets of fixed gibs 25 are vertically mounted on columns 1, 2. Fixed gibs 25 are mounted opposite each vertical corner of slide 6. Two sets of slide gibs 24 are vertically mounted on each corner of slide 6. Slide gibs 24 engage and slide on corresponding fixed gibs 25, as will be explained. Slide gibs 24 have a partially circular construction, as will be explained.

Figure 12:
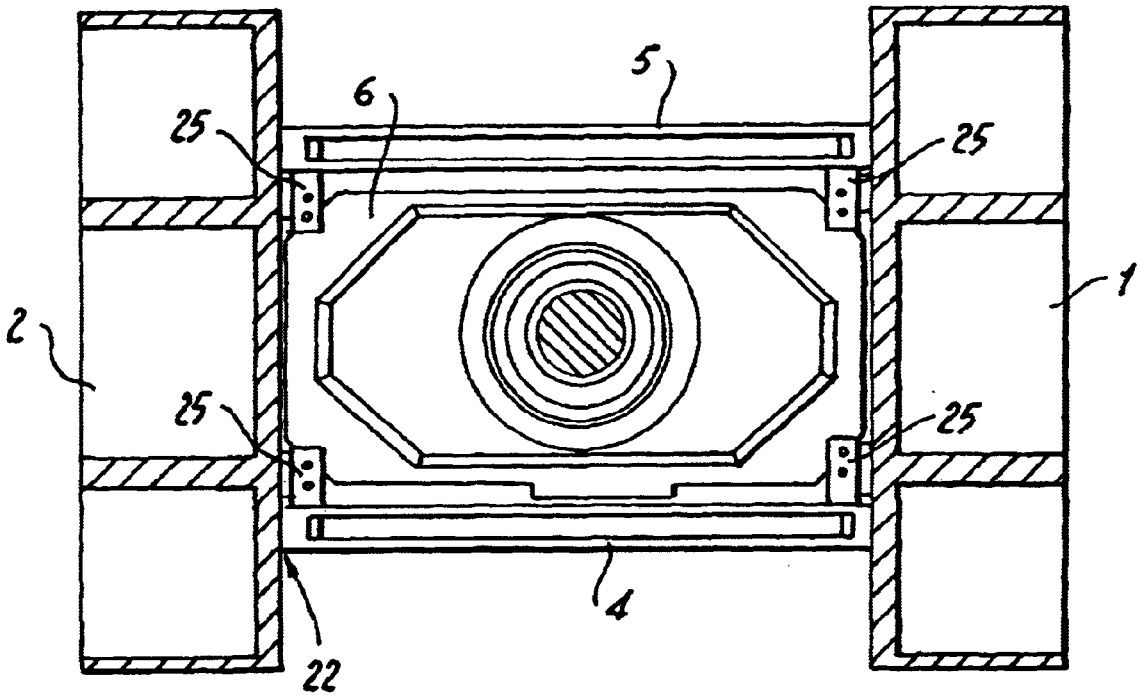
FIG. 12 is a cross-section from the view along the line A—A in FIG. 10.

Additionally referring now to FIG. 12, fixed gibs 25 have the shape of a vertical rectangle. Each outside vertical corner of slide 6 is formed in the shape of an 'L' corresponding to the shape of fixed gibs 25.

Stays 4, 5 are between columns 1, 2 adjacent an outer surface of fixed gibs 25. Stays 4, 5 provide extensive support and vibratory damping to slider link press 50, as will be explained. A spacer 22 inserted on one surface between stays 4, 5 and respective columns 1, 2 and maintains a required spacing. A required spacing between columns 1, 2 is maintained by adjusting a thickness of spacer 22 while retaining rigidity. Spacer 22 also acts to absorb and distribute deformation pressure on columns 1, 2 during adjustment of stays 4, 5.

Figure 13:
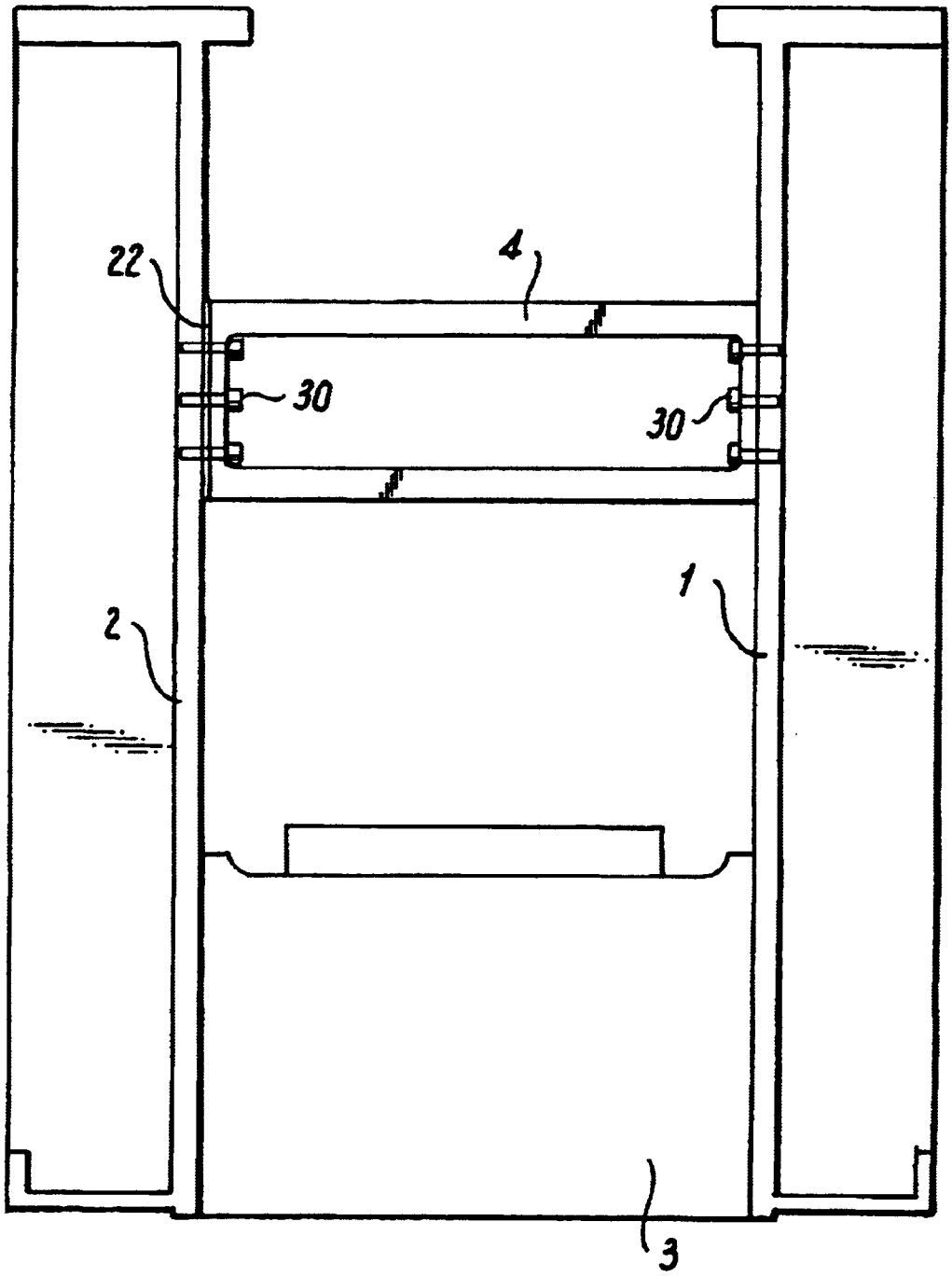
FIG. 13 is a front view of FIG. 12.
Figure 14:
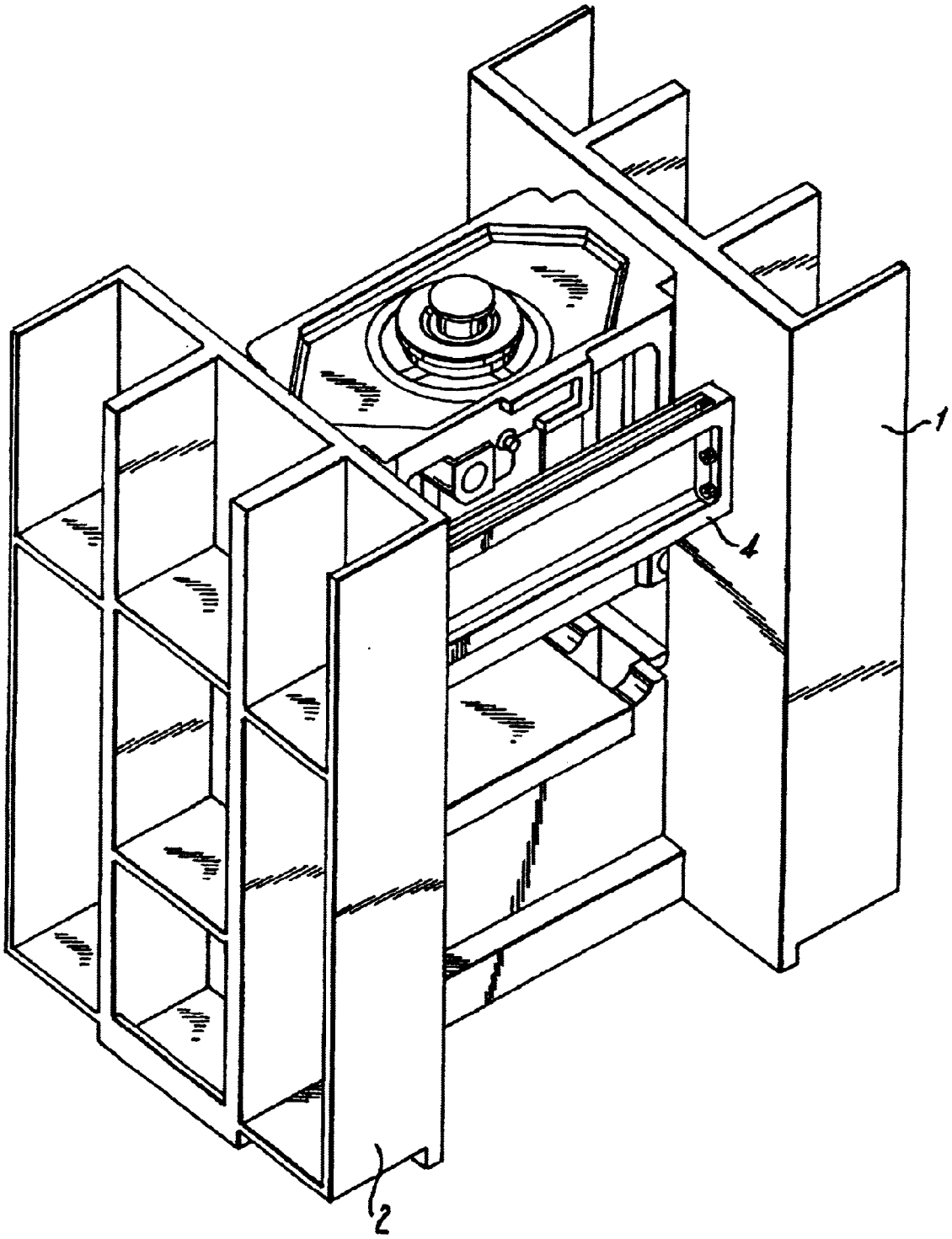
FIG. 14 is a partial perspective view FIG. 13.

Additionally referring now to FIGS. 13 and 14, bolts 30 affix stays 4, 5 to respective columns 1, 2. Bolts 30 are inserted from an inside surface of stays 4, 5, through spacers 22 and into respective columns 1, 2 and tightened to ensure horizontal rigidity and resistance to eccentric loads on slide 6. It should be understood that additional methods of rigidly affixing stays 4, 5 to columns 1, 2 are available but must minimize vibration, increase rigidity, minimize deformation and serve similar functions to bolts 30.

Figure 15:
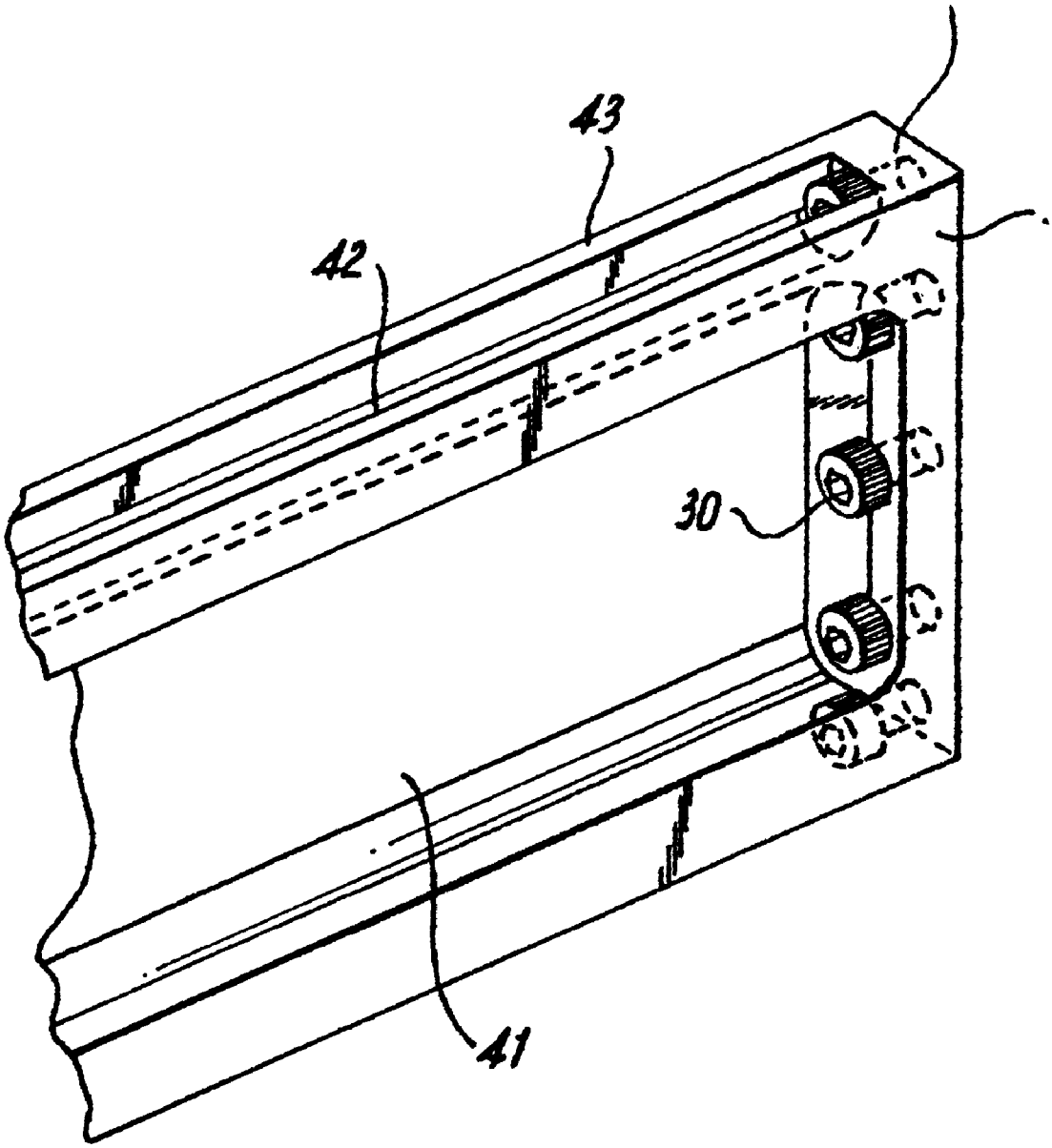
FIG. 15 is a partial view of a stay of FIG. 14.

Additionally referring now to FIG. 15, each stay 4, 5 includes a front thick board 42, a back thick board 43, and a side board 44. An open window 41 is formed through the center of boards 42, 43. During assembly, side board 44 is tightened to respective columns 1, 2 by bolts 30 from an interior side. Spacer 22 additionally aids in preventing damage, and absorbing and distributing deformation pressure to columns 1, 2 during tightening of bolts 30. To increase horizontal and transverse rigidity, stays 4, 5 may be alternatively formed as a single unit or with additional supporting members.

Figure 16:
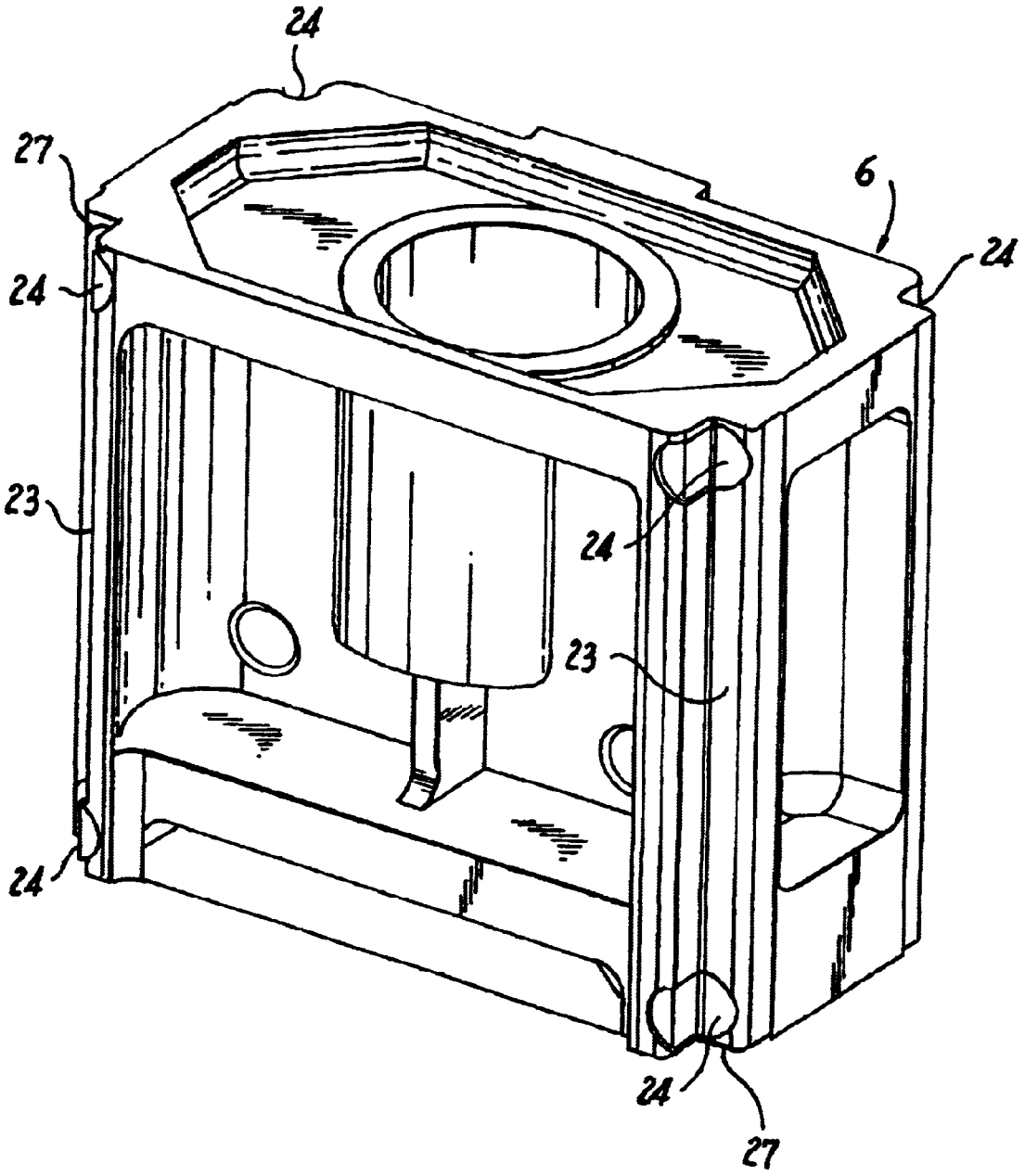
FIG. 16 is a perspective view of a slide.
Figure 17:
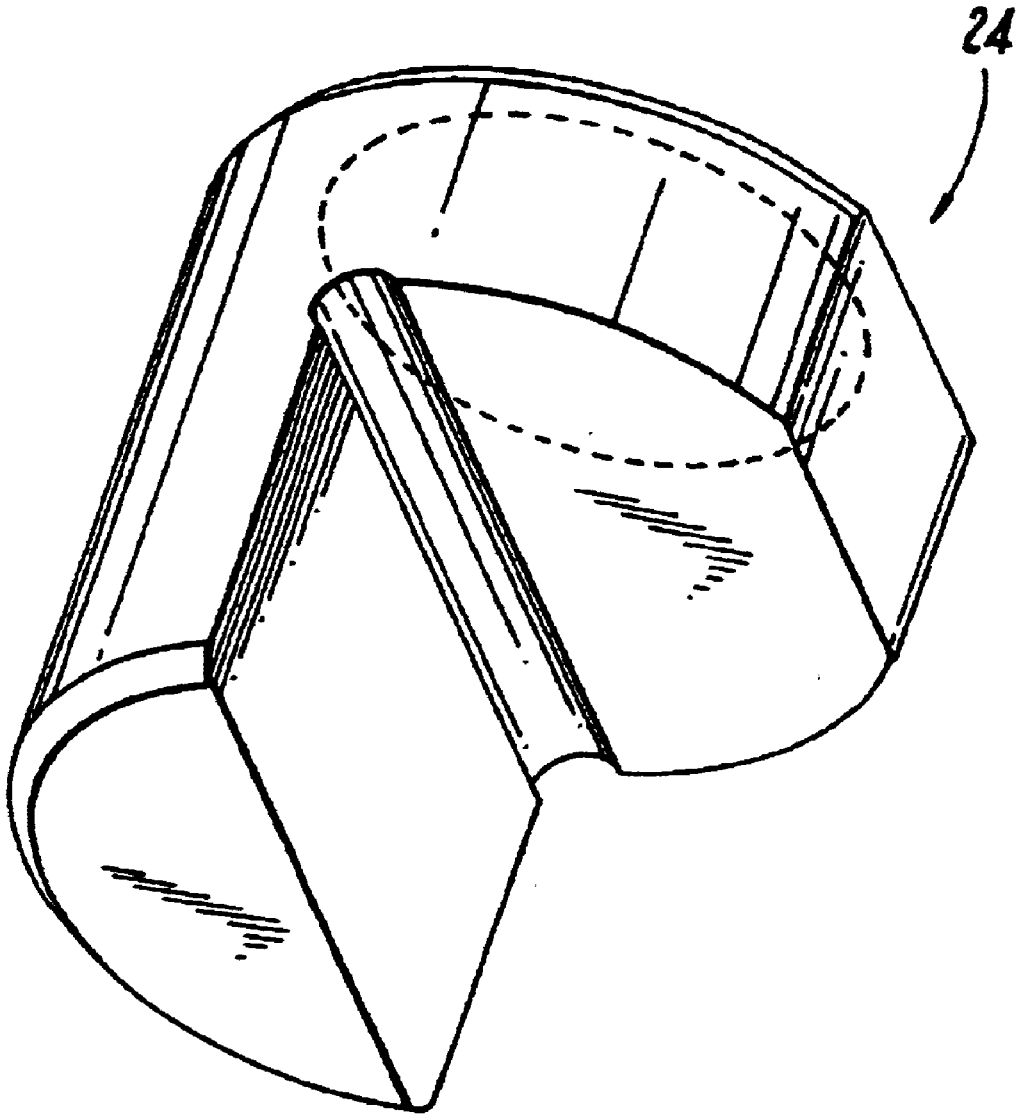
FIG. 17 is a perspective view of a slide gib as seen in FIG. 16.

Additionally referring now to FIGS. 16 and 17, a corner surface 23 is on each vertical corner of slide 6. Corner surfaces 23 are formed corresponding to fixed gibs 25, described above. Corner surfaces 23 have an L-shaped cross-section, but may be adapted to other shapes referenced to fixed gibs 25. Holes 27 are at a top and bottom position of each corner surface 23, opposite fixed gibs 25.

Sliding gibs 24 are in respective holes 27 opposite fixed gibs 25. Sliding gibs 24 have a circular cross-section corresponding to holes 27 and a two-plane-L-shaped face corresponding to corner surfaces 23. The L-shaped faces of sliding gibs 24 match the outside corner surfaces of fixed gibs 25. Sliding gibs 24 rotate within holes 27 to accommodate any torsion placed upon slide 6 during operation, as will be explained.

It is to be understood, that when slide 6 is at the bottom dead center position, stays 4, 5 are positioned, equidistant, between top and bottom slide gibs 24. As a result, stays 4, 5 are positioned to counter the affects of maximum pressure (torsion) during operation. As indicated above, it is to be understood that maximum pressure (torsion) is at the bottom dead center position.

During normal operations, slide 6, through connecting link 17 and oscillating link 12 work to maintain alignment between corner surfaces 23 of slide 6 and fixed gibs 25. Precise balance is difficult to maintain during the complete operation cycle and slide 6 may operate in an non-uniformly parallel manner (i.e. the result of an eccentric load) for a period of time.

Where an eccentric load operates to shift slide 6, the L-shaped face of slide gibs 24 contacts the corresponding surface of fixed gibs 25, and holes 27 allow slide gibs 24 to rotate, maintain parallel contact, accommodate any eccentric load. This operation ensures smooth press operation and extends life. Where an eccentric load is larger than expected, the above invention also accommodates additional load through the use and correct positioning of strays 4, 5 on columns 1, 2. As a result, the phenomenon of "linear contact" and "slide galling" found in the related art is eliminated and seizure of the guide surfaces and slide 6 is eliminated.

Further, it is to be understood, that the use of spacers 22 prevents damage to columns 1, 2, by both acting as slip planes to eliminate over-tightening damage, and by acting to ensure spacing alignment with slide 6 to resist eccentric force.

Since slide gibs 24 have an L-shaped face, there are two surfaces that match the two corresponding surfaces of each fixed gib 25 and, through contact, and rotation maintain alignment of slide 6. Since slide gibs 24 pivot in the direction of surface contact, the L-shaped face is maintained in parallel, surface contact alignment with the surfaces of fixed gibs 25.

In combination, columns 1, 2, stays 4, 5, ribs 3, 9, and the other elements of slider link press 50 easily provide horizontal rigidity to ensure a maximum available pressure (torque) with a low maintenance that is not found in the related art.

Although only a single or few exemplary embodiments of this invention have been described in detail above, those skilled in the art will readily appreciate that many modifications are possible in the exemplary embodiment(s) without materially departing from the novel teachings and advantages of this invention. Accordingly, all such modifications are intended to be included within the scope of this invention as defined in the following claims. In the claims, means-plus function clauses are intended to cover the structures described herein as performing the recited function and not only structural equivalents but also equivalent structures. Thus although a nail and screw may not be structural equivalents in that a nail relies entirely on friction between a wooden part and a cylindrical surface whereas a screw's helical surface positively engages the wooden part, in the environment of fastening wooden parts, a nail and a screw may be equivalent structures.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A slider link press device having a front face and an opposing rear face, the device comprising:

a crank shaft lying along a longitudinal axis extending in the direction from said front face to said rear face resulting in the crank shaft being orientated in a front-rear direction;

a fulcrum shaft lying along a longitudinal axis extending in the direction from said front face to said rear face;

first means for linking said crank shaft to said fulcrum shaft;

said first means having a body that is pivotably retained on one side by said fulcrum shaft and being operable in a first arc about said fulcrum shaft, said body lying along an axis that is at least substantially parallel to said front and rear faces;

said body of said first means being perpendicular to said crank shaft and said fulcrum shaft;

a crank pin on said crank shaft;

said crank pin providing an eccentric displacement to said first means;

a slide having a top and a bottom dead center position;

second means for linking said first means to said slide;

said first means increasing a force applied to said slide at said bottom dead center and increasing a slide descent time whereby a precision increases and decreases a slide assent time;

guide means for guiding said slide in said cycle;

said guide means eliminating eccentric loads upon said slide during said cycle, whereby said precision increases; and a drive means for driving said press device and apply said force to said slide.

2. A slider link press device, according to claim 1, further comprising:

a fulcrum shaft center on said fulcrum shaft;

said first means being horizontal to said fulcrum shaft center at said bottom dead center position;

said eccentric displacement being a trajectory circle of said crank pin;

an angular velocity of said crank shaft being constant;

a first position (O) being a rotation center of said crank shaft;

a first tangent point (PT) being defined on said trajectory circle at said top dead center position respective to said fulcrum shaft center;

a second tangent point (PR) being defined on said trajectory circle at said bottom dead center position horizontal to said fulcrum shaft center;

a first angle ($\theta 1$) is a first means oscillation angle defined between said first tangent point (PT), said fulcrum shaft center, and said second tangent point (PR);

a second angle ($\theta 2$) is defined between said first tangent point (PT), said first position (O), and said second tangent point (PR);

said first angle ($\theta 1$) and said second angle ($\theta 2$) have the following relationship;

$$(\theta 2)\ \text{minimum} = 180\ \text{degrees} - (\theta 1) \quad \text{(V)}$$

$$(\theta 2)\ \text{maximum} = 180\ \text{degrees} + (\theta 1) \quad \text{(VI)}$$

and, said second means descends under relationship (VI) whereby said slide descent time is increased.

3. A slider link press device, according to claim 2, wherein:

a distance L1 is defined between a maximum eccentricity of said crank pin and said fulcrum shaft center;

a distance L2 is defined between the center of said first means and said fulcrum shaft center;

a center of said first means is a center axis of said slide;

a first torque applied to said crank pin is F1;

a second torque applied to said slide is F2;

said first torque being at a minimum where F1=F2 and said slide is at said top dead center position and said bottom dead center positions;

said second torque is said force and is at a maximum at said maximum eccentricity of said crank pin and where F2=F1×L1/L2 and said first means is effective to increase said second torque; and said slider link press device effective to increase said second torque during said cycle of said slide as said crank pin travels from said top dead center position to said bottom dead position.

4. A slider link press device, according to claim 3, further comprising:

a drive assembly;

a speed reducing module and a fly wheel in said drive assembly;

said drive assembly being effective to drive said crank shaft;

a frame assembly supporting said drive assembly and said slide; and said crank shaft above said slide.

5. A slider link press device, according to claim 4, wherein:

a crown assembly in said frame assembly;

said crown assembly above said slide;

said first means, said crank shaft, and said fulcrum shaft in said crown assembly; and said fly wheel having a center of gravity below said crown, and increasing a stability of said slider link press and reducing operating vibration.

6. A slider link press device, according to claim 5, wherein:

said slide includes a vertical slide center position;

said slide center position being a press center; and a center of said crank shaft being vertically aligned with said press center position.

7. A slider link press device, according to claim 5, further comprising:

at least first and second column in said frame;

said first and second columns below said crown;

at least a first and a second stay;

said first and second stay between said first and second columns when said slide is at said bottom dead center position; and said first and second stays operably joining said first and second columns whereby said columns are retained in parallel and said frame resists a high operating pressure and an eccentric slide pressure.

8. A slider link press device, according to claim 2, further comprising:

a plurality of fixed gibs in said guide means;

said fixed gibs arrayed along an inner surface of a first and a second column of said slider link press;

a plurality of corner surfaces on said slide;

said plurality of fixed gibs aligned adjacent each respective said corner surface;

each said corner surface being slidably aligned with each respective said fixed gib;

a plurality of slide gibs in said guide means;

said plurality of slide gibs on said plurality of corner surfaces;

each said slide gib having a first engagement surface;

each said slide gib having a second engagement surface;

said guide means permitting pivoting of said slide gibs relative to each respective said fixed gib; and said guide means being effective to maintain each said first and said second engagement surface parallel to each respective said fixed gib to eliminate eccentric forces on said slide and guide said slide in said cycle, whereby a durability of said slider link press increases.

9. A slider link press device, according to claim 8, further comprising:

a plurality of holes in said guide means;

each said slide gib in each respective said hole;

each said slide gib pivotable in each respective said hole;

said holes at at least one of a top side and a bottom side of each said corner surface;

a first and a second stay on said slider link press;

said first and second stays equidistant to each respective said slide gib at said bottom dead center position; and each said stay, said slide gibs, and said guide means being effective to absorb said eccentric forces whereby said first and second columns are maintained in parallel and said slide operates parallel to said fixed gibs.

10. A slider link press device, according to claim 9, further comprising:

a plurality of spacers;

said spacers between each said stay and a first and a second column on said slider link press;

said spacers selectable to maintain said first and second columns in respective parallel positions about said slide; and said spacers being a slip planes and minimizing damage to said first and second columns during tightening of each respective said stay.

* * * * *